United States Patent [19]

Young et al.

[11] 4,282,800

[45] Aug. 11, 1981

[54] FLUID PRESSURE ACTUATOR

[75] Inventors: Alastair J. Young, Kenilworth; John P. Burke, Leamington, Spa, both of England

[73] Assignee: Automotive Products Limited, Warwickshire, England

[21] Appl. No.: 83,225

[22] Filed: Oct. 10, 1979

[30] Foreign Application Priority Data

Oct. 16, 1978 [GB] United Kingdom ..... 40698/78

[51] Int. Cl.[3] ..... E05B 65/38; F01B 19/00

[52] U.S. Cl. ..... 92/37; 70/264; 92/48; 92/63; 92/64; 92/129

[58] Field of Search ..... 92/37, 44, 48, 61, 64, 92/129, 63; 70/264

[56] References Cited

U.S. PATENT DOCUMENTS

| | | | |
|---|---|---|---|
| 1,454,886 | 5/1923 | Giesler | 92/44 X |
| 2,649,843 | 8/1953 | Province | 92/48 |
| 2,704,540 | 3/1955 | Engelder | 92/44 X |
| 2,969,776 | 1/1961 | Riester | 92/48 |
| 2,976,085 | 3/1961 | Grogan | 92/48 X |
| 3,218,593 | 11/1965 | Jonke | 92/48 X |
| 3,498,189 | 3/1970 | Andres | 92/48 X |
| 4,189,454 | 2/1980 | Detweiler | 92/129 |

*Primary Examiner*—Irwin C. Cohen

*Attorney, Agent, or Firm*—Kemon & Estabrook

[57] ABSTRACT

This invention relates to fluid pressure servo motors having two operatively independent fluid chambers, each chamber having a piston means therein movable in response to a fluid pressure differential so as to alter in use a two position device from one to the other of said two positions, each piston means having a lost motion means connection to allow the idle return of the piston in the event of cessation of the fluid pressure differential, wherein the two pistons are co-axial and move in opposite directions in response to the pressure differential and one piston is fixed to a stirrup formed as a wire loop which bridges the other piston to act in use against said device.

6 Claims, 3 Drawing Figures

FLUID PRESSURE ACTUATOR

This invention relates to fluid pressure servo motors that in use move a two position device from one to the other of said two positions. Such actuators are particularly useful for moving door lock mechanisms on motor vehicles, from a locked condition to an unlocked condition or vice versa.

The use of vacuum operated servo motors for locking and unlocking of motor vehicle doors is well known. Examples of typical vacuum servo motors are illustrated in British Pat. Nos. 1 226 898 and 1 259 487. The servo motors illustrated in these patents comprise two independantly operated fluid members separated by a single diaphragm which moves in response to a partial vacuum being created in one or other of the two chambers. The actuation rod which connects the diaphragm to the lock mechanism has to pass through an end wall of one of the fluid chambers and thus there is a problem with sealing the movable rod relative to the vacuum chamber wall.

The herein disclosed servo motor provides a simplified construction in which the problem of actuation rods moving relative to stationary seals has been eliminated.

According to this invention there is provided a fluid pressure servo motor having two operatively independent fluid chambers, each chamber having a piston means therein movable in response to a fluid pressure differential so as to move, in use, a two condition device from one to the other of said two conditions, each piston means having a lost motion means connection with said device to allow the idle return of said piston in the event of cessation of the pressure differential, wherein the two pistons are co-axial and move in opposite directions in response to the pressure differential and one piston is fixed to a stirrup formed as a wire loop which bridges the other piston to act in use against said device.

Also according to this invention there is provided a vehicle door locking system having an actuator as described above.

The invention will be described by way of example and with reference to the accompanying drawings in which.

Figure 1:
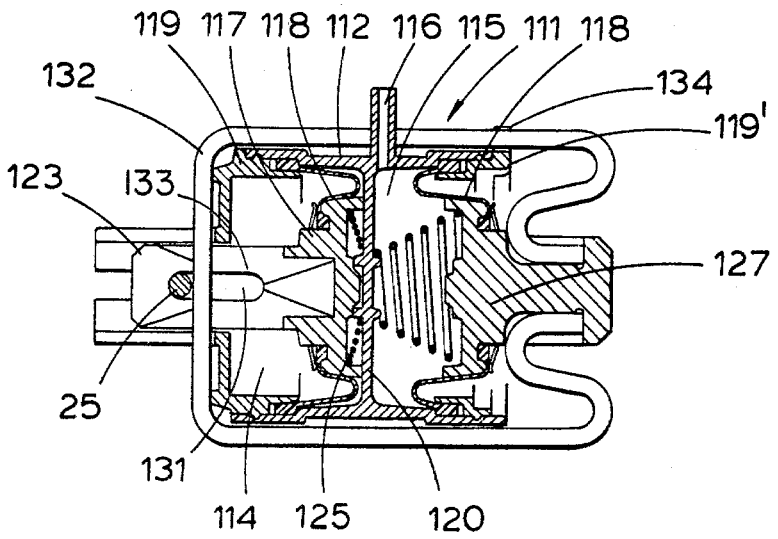
FIG. 1 shows a longitudinal cross section through a servo motor according to this invention.

The servo motor 111 comprises a polypropylene stationary body 112 which in use is fixed by a bracket to, for example a door, and the servo motor is utilised for moving a door lock between lock and unlock conditions. The housing 112 has two co-axial independent fluid chambers 114 and 115 separated by a common wall 120 and each being independently connected by outlets 116, only one of which is shown, to a vacuum source (not shown).

Each chambers 114 and 115 contain a respective piston 117 and 127, each of which supports a rolling diaphragm 118 sealed and fixed to the housing 112 by a snap-in plastics collar 119' which crimps the diaphragm against a shoulder in the mouth of each chamber. The collar 119' for the chamber 114 also supports the piston 117.

The two pistons 117 and 127 work in opposition to each other, such that when a pressure reduction is introduced only into a given one of the 114 or 115 chambers, the respective piston 117 or 127 moves axially towards the wall 120 separating the two chambers, there being spring 125 located between each piston and the wall 120 to bias the piston for an idle return when the vacuum in the chamber is released.

The position of the piston 117 is shown in FIG. 1 in its actuated state. The piston 117 is connected to a lock member 25 through a lost motion device constituted by the axially elongated diametral slot 131 in the stem 123 of the piston 117. The lock member member 25 is shown in the "locked" position, the elongated slot 131 allowing the piston 117 to idle return without interfering with the position of the lock member 25. Hence when the lock is unlocked manually the lock member 25 can be returned back along the slot 131 without disturbing the condition of the actuator.

The second piston 127 acts against the lock member through a stirrup 132 formed from a loop of wire secured to the second piston 127. The stirrup being fashioned so that with the servo motor 111 in the condition as shown in FIG. 1, the lock member 25 is in the "locked" position and abuts the wire loop 132 fixed to the piston 127 in its "at rest" position. When the piston 117 is in its "at rest" position and the piston 127 is acted upon by vacuum in the chamber 115, it moves towards the wall 120 and hence moves the stirrup 132 and the lock member 25, back along the axial slot 131 whose position is now shown by dotted lines, to the "unlocked" position. This movement of the wire loop 132 is accommodated by a second diametral slot 133 in the stem 123 of the piston 117 which is angularly offset from the first slot 131. Further as can be seen from the drawing the loop is guided for movement by lugs 134 located on the outer surface of the body 112.

When the vacuum is released the piston 127 is returned by its spring and moves the wire loop 132 away from the lock member 25 so that there is lost motion clearance between the lock member 25 and the wire loop 132. This lost motion clearance allows the lock to be manually "locked" without disturbing the state of the servo motor.

Figure 2:
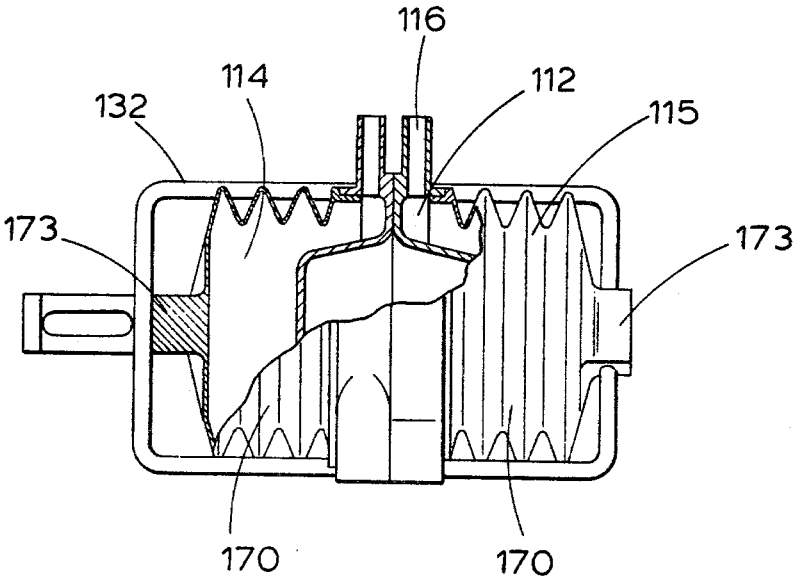
FIG. 2 shows a section through a modification of the servo motor of FIG. 1.

FIG. 2 shows a servo motor which is a modification of FIG. 1. For each chamber 114 or 115 the snap-in collar 119, diaphragm 118, and the respective piston 117 or 127 are replaced by a single diaphragm 170 of bellows type construction which is moulded from a synthetic rubber and which has an integral stem 173 for connection of the diaphragm 170 to either the stirrup 132 or a lock member. Because each of the diaphragms form the actual chamber wall, the body of the servo motor can be considerably reduced in size and become merely a platform for mounting the diaphragm 170 thereon, and for containing the pipes 116 for the passage of air to and from the chambers 114 and 115. Because the bellows is a resilient form of construction then each bellows acts as its own return spring to return the stem to its original position.

Figure 3:
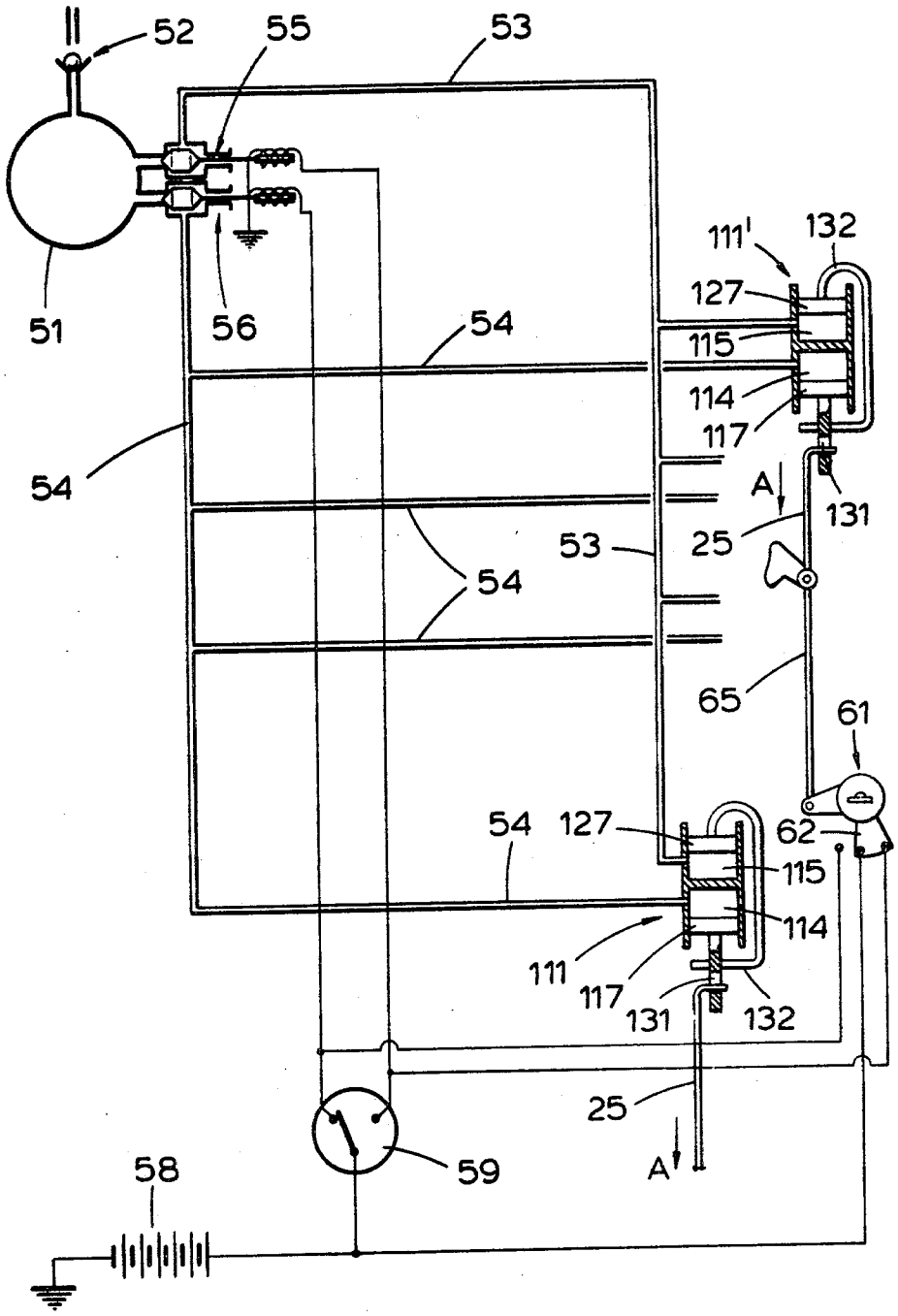
FIG. 3 shows a schematic diagram of a motor vehicle door locking system having servo motors as described herein.

With reference to FIG. 3, this shows a scheme for a vehicle door locking system which can utilise any of the servo motors shown in FIG. 1 or FIG. 2. However, for the sake of example the system utilises the servo motors shown in FIG. 1. A vacuum reservoir 51 is connected via a one way valve 52 to the inlet manifold of an internal combustion engine. The reservoir 51 is connected through two separate conduits 53 and 54, via respective solenoid operated valves 55 and 56 to the locking and unlocking chambers 114 and 115 respectively of a plurality of servo motors 111 as shown in FIG. 1. In FIG. 3 only two servo motors are shown but there may be at least four servo motors, one per door lock on a four door car.

The power for the solenoids is provided by the battery 58 of the vehicle and the solenoid valves 55 and 56 are operated by central control switches, a first switch 59 accessible within the passenger compartment of the vehicle and a second switch 62 associated with the driver's door lock 61. There may also be another switch on the front passenger door lock.

With the vehicle unlocked, as in FIG. 3, to lock the doors the solenoid 56 only is energised to pull the associated valve away from the reservoir 51. This shuts off the air and connects the vacuum via the conduit 54 with first chambers 114 of the servo motors 111. The solenoid 56 is actuated by either the spring loaded switch 59 within the car or by the switch 61 associated with the driver's lock.

When a vacuum acts within the chambers 114 the associated lock members 25 are moved counter to the direction of arrow A to lock all the respective locks. When the switch 59 or 61 is released the solenoid 56 de-energises, the associated valve moves to cut-off the vacuum and allows air to re-enter the conduits 54. The respective pistons return to their original positions, as described previously, without disturbing the locked state of the door.

To unlock the doors the solenoid 55 is energised, again through either of the spring loaded switches 59 or 61 which are moved to energise the solenoid 55 without energising the solenoid 56 at the same time. The valve associated with the solenoid 55 closes to shut off the air supply and connect the vacuum reservoir with the chambers 115 of the actuators via the conduit 53. This causes the respective pistons to move the stirrups 132 to return the lock members 25 in the direction of arrow A without disturbing the first pistons, since the lost motion connection 131 and 133 accommodates such movement.

All doors have a normal manual operation only the driver's door lock 62 is shown with a manual over-ride 65 with the respective lock so that if the vacuum fails or the electrical supply to the solenoid fails the driver's door can be locked or unlocked as is necessary.

We claim:

1. A fluid pressure servo motor comprising:

a body;

two co-axial fluid chambers supported by the body and being operatively independent a pair of co-axial piston means located one in each chamber and being movable in opposite directions in response to a pressure in their respective chamber, a two condition member movable in opposite directions from one to the other of said two conditions by said pair of piston means, and each piston means having a lost-motion means connection with said member for abutting engagement therewith and to allow idle return of the piston means without movement of said member in the event of cessation of the pressure; and a stirrup formed from a loop of wire which is fixed to one piston means and bridges the other piston means to act in use against the two position member, said other piston means and said stirrup defining a lost motion connection therebetween such that said other piston means is able to move independently of the stirrup.

2. A servo motor as claimed in claim 1, wherein the piston means bridged by the wire loop has a first elongated diametral slot therein for engagement with said member to move it into one condition when that piston means is actuated, and a second elongated slot angularly off set from the first slot which permits relative movement of the bridged piston means relative to the wire loop such that said wire loop is engageable with said member to return it to its original condition when the piston means carrying the stirrup is actuated.

3. A servo motor as claimed in claim 2 wherein said chambers are defined within the body, and support means are located on the outer surface of the body to support and guide the movement of the wire stirrup.

4. A servo motor as claimed in claim 3 wherein a spring in each chamber acts on each respective piston means to return same to an at-rest position when the pressure ceases.

5. A fluid pressure servo motor as claimed in claim 1 wherein a bellows is utilized as each piston means, and each bellows is attached to the body of the servo motor such that said chambers are defined within each bellows, and each bellows has an integral axial stem for connection to either of the wire stirrup or said member.

6. A fluid pressure servo motor as claimed in claim 5, wherein the servo motor body provides a mounting base to which the bellows are welded, each bellows thereafter providing boundary walls of the chamber and acting in resilient fashion to spring return its stem to an original position.

* * * * *